US005172735A

United States Patent [19]

Kleiner

[11] Patent Number: 5,172,735

[45] Date of Patent: Dec. 22, 1992

[54] BELT DRIVEN WEFT THREAD SUPPLIERS

[75] Inventor: Walter Kleiner, Hirzel, Switzerland

[73] Assignee: Lindauer Dornier Gesellschaft mbH, Lindau, Fed. Rep. of Germany

[21] Appl. No.: 771,190

[22] Filed: Oct. 4, 1991

[30] Foreign Application Priority Data

Oct. 5, 1990 [CH] Switzerland ..... 03215/90

[51] Int. Cl.[5] ..... D03D 47/34; D03D 47/38

[52] U.S. Cl. ..... 139/453

[58] Field of Search ..... 139/453

[56] References Cited

U.S. PATENT DOCUMENTS 4,913,195 4/1990 Speich ..... 139/450 X 4,964,443 10/1990 Van Bogaert et al. ..... 139/453

FOREIGN PATENT DOCUMENTS 8800691 6/1990 Belgium .

0293558 7/1988 European Pat. Off. .

*Primary Examiner*—Andrew M. Falik

*Attorney, Agent, or Firm*—W. G. Fasse

[57] ABSTRACT

A weft thread selecting and supplying device has an electronically controllable electric motor (2) with a drive wheel (4) and a guide wheel (5), and a gear belt (6) which loops around these wheels. Thread suppliers (7, 7*a*) are connected to both longitudinal runs of the gear belt (6) and staggered relative to each other so that one thread supplier (7*a*) is in a ready position (B) and the other is in a transfer position (U). The thread suppliers (7, 7*a*) have thread eyes (9) through which the weft threads (17, 17*a*) run. In the ready position (B) the weft thread (14*a*) is outside of the take along range of a weft thread insertion gripper head (15). In the transfer position (U) the weft thread (17) is in a position to be gripped by the gripper head (15). The electric motor (2) rotates the drive wheel (4) in accordance with the pattern being woven and in synchronism with the weaving cycle, whereby the drive wheel (4) moves the gear belt (6). The positions of the thread suppliers (7, 7*a*) are thereby positively and repeatedly exchanged when the motor (2) is driven in one direction or in the opposite direction.

8 Claims, 1 Drawing Sheet

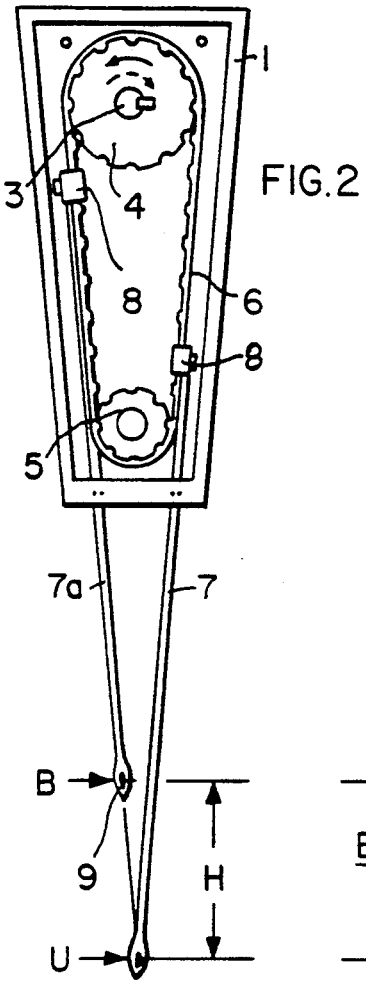
FIG.2
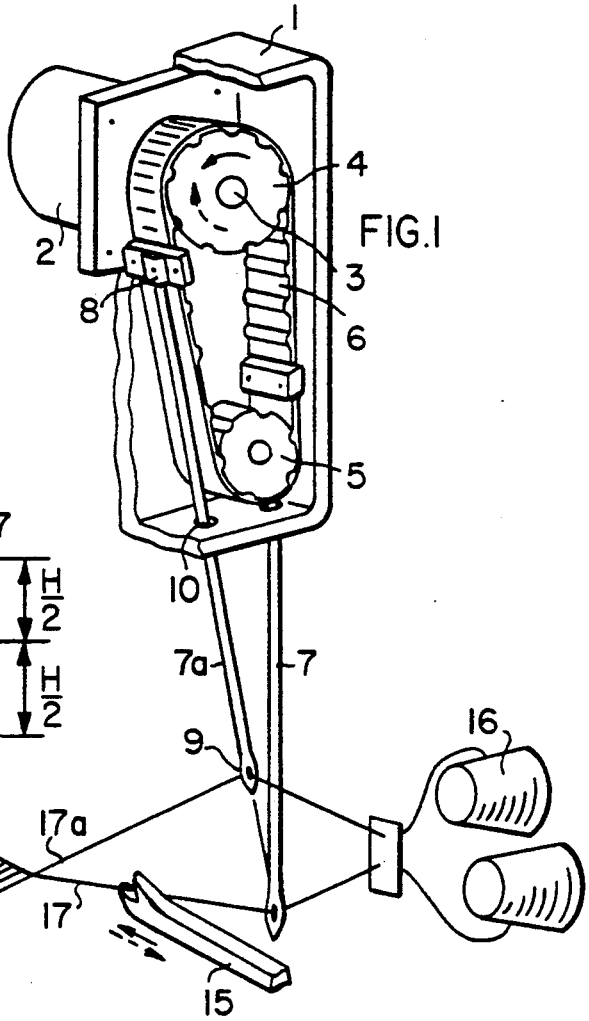
FIG.1
FIG.3
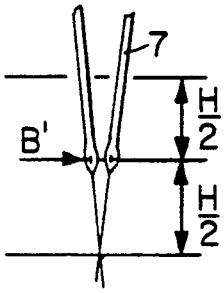
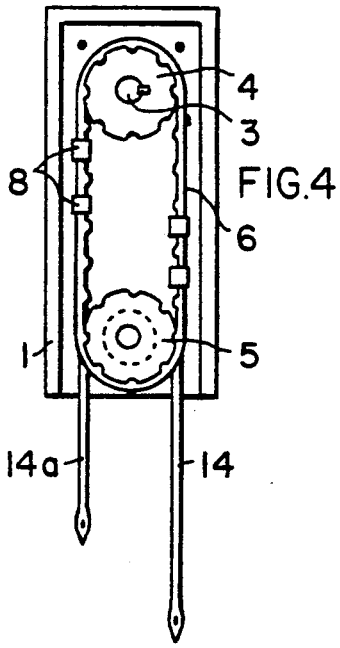
FIG.4
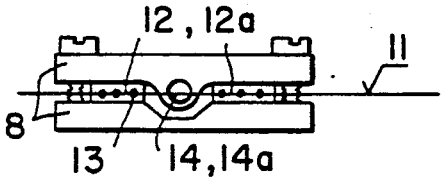
FIG.5

BELT DRIVEN WEFT THREAD SUPPLIERS

FIELD OF THE INVENTION

The invention relates to an apparatus for selecting and supplying weft thread to a weaving machine, wherein weft thread suppliers are moved between a ready position and a transfer position.

BACKGROUND INFORMATION

Known selecting devices, such as are disclosed in Belgian Patent Publication BE 8,800,691 or in Swiss Patent Publication CH 1285/87 use push and pull elements moved by control cams. Transfer members cooperating with thread suppliers, are coupled to or disconnected from these push-pull elements by means of electromagnets. The mechanisms necessary for such devices include, in addition to the control cams, a multitude of levers, pawls, springs, pivot points, and magnets. Thus, these devices are trouble prone with regard to their functional reliability. Additionally, these devices are subject to substantial wear and tear, especially when conventional high weaving speeds are taken into account. Additionally, these devices can be uncomfortable sources of noise. Moreover, a gentle guiding of the weft threads is not possible due to a vibration tendency.

OBJECT OF THE INVENTION

It is the object of the invention to provide a simple and functionally secure weft thread selecting and supplying apparatus which is easy to operate and efficient to service.

SUMMARY OF THE INVENTION

The present apparatus has a housing with an electric motor flanged to the housing, preferably a stepping motor or a d.c. motor. A drive wheel is secured to the motor shaft so that the drive wheel is driven by the shaft. A guide wheel is secured to the housing below the drive wheel. A belt, preferably a gear belt, or a roller chain loops around both wheels. One thread supplier is secured to each of the two belt runs in a form-locking, that is in a positive, manner so that one thread supplier is in a ready position while the other is in a thread transfer position. If the thread suppliers must change their end positions, the electronically controlled motor rotates the drive wheel in the respective direction until the thread suppliers have exchanged their end positions. The thread suppliers remain in their respective end positions until another weft thread is to be woven in accordance with the weaving pattern.

If more than two different weft threads are necessary for the weaving operation, the supply apparatus is used only with one thread supplier, however, one apparatus is provided for each weft thread.

It is, however, also possible, when more than two different weft threads are used in the weaving, to control the supply apparatus with two each thread suppliers, electronically in such a way that three holding and rest positions for the thread suppliers occur, whereby, for example, only four supply apparatuses are needed for eight weft threads. In such a multiple arrangement of supply apparatuses, one thread supplier in one supply apparatus is always in the transfer position and the other thread supplier is in the "up" or ready position while the thread suppliers of the other supply apparatus remain in the "center" or ready position where the thread eyes cross each other and where it is not possible for the weft thread insertion gripper head to entrain weft threads. Each thread supplier is in one of the three positions in accordance with the weaving pattern control program for the electromotors. These positions are changed around in the course of the weaving operation.

BRIEF DESCRIPTION OF THE DRAWINGS

Example embodiments of the invention will now be described with reference to the accompanying drawings, wherein:

FIG. 1 shows a perspective view of the present weft thread selecting and supplying apparatus with one thread supplier in the transfer position and with the other thread supplier in the ready position;

FIG. 2 shows a front plan view of the apparatus of FIG. 1 in a schematic illustration;

FIG. 3 shows schematically the thread holding ends of both thread suppliers simultaneously in an intermediate, ready position;

FIG. 4 shows a front plan view of another embodiment of a thread selecting and supplying apparatus wherein thread suppliers are movable in parallel to each other; and FIG. 5 is an end view onto a securing element for attaching a thread supplier to two belts so that the thread supplier is located in the same plane as both belts.

DETAILED DESCRIPTION OF PREFERRED EXAMPLE EMBODIMENTS AND OF THE BEST MODE OF THE INVENTION

During the weaving operation weft threads 17 or 17*a* are inserted into the loom shed by a weft thread insertion gripper head 15 pulling the thread off supply coils 16. The selection and presentation of the weft threads 17, 17*a* takes place in accordance with a weaving pattern by electronically controlling a reversible drive including an electromotor 2 which is secured to a housing 1 and which has secured to the motor shaft 3 a drive wheel 4 in a torque transmitting manner for rotating the wheel 4. A guide wheel 5 is rotatably secured to the housing 1. The guide wheel 5 has a smaller diameter compared to the larger diameter of the drive wheel 4. The on-center spacing between the rotational axes of wheels 4 and 5 and the diameter difference between the drive wheel 4 and the guide wheel 5, are so dimensioned that the extension straight lines of the belt runs of the looping belt 6 intersect in a thread transfer or thread presenting position U. The belt 6 shown as a gear belt runs without slip. Thread suppliers 7, 7*a* are secured to the belt 6 by means of securing elements 8. Each of the thread suppliers 7,7*a* is guided by a respective guide hole 10 in the housing 1 and both thread suppliers run in parallel to the respective belt run. The weft threads 17, 17*a* slide through the thread eyes 9 of the thread suppliers 7, 7*a*. Thus, each of the two thread suppliers is driven by its respective belt run, at different times, into said position U for presenting a respective weft thread to said gripper head.

As shown in FIG. 2, for example, the thread supplier 7 is in the transfer position U with its thread eye 9 and the weft thread 17, while the thread supplier 7*a* with its thread eye 9 and the weft thread 17*a* is in the ready position B. Positions B and U are spaced from each other by a spacing H. If it becomes necessary in accordance with the weaving pattern that the weft thread 17*a* must be brought into the transfer position U, the electric motor 2 is correspondingly controlled, namely reversed as indicated by the two arrows shown on drive wheel 4 in FIGS. 1 and 2. The drive wheel 4 drives the belt 6, thereby moving the thread supplier 7*a* with the weft thread 17*a* into the transfer position U while the thread supplier 7 is positively pulled back into the ready position B. The crossing of the weft threads 17, 17*a* takes place halfway between positions B and U with a mutual spacing between the thread suppliers 7*a*, 7 so that jamming of the threads is excluded.

If it is necessary that more than two different weft threads are to be selected, correspondingly more apparatuses are to be employed. Thereby, the control program for the electromotors is so programmed that of all apparatuses employed only the thread supplier according to the presently used weaving pattern is in the transfer position U, while all other thread suppliers are in the ready position B' halfway H/2 between the positions B and U as shown in FIG. 3 or one thread supplier is in the ready position B.

FIG. 4 shows an apparatus with drive wheel 4 and guide wheel 5 having the same diameters, whereby thread suppliers 14, 14*a* are travelling along parallel lines. As shown in FIG. 5, thread suppliers 14, 14*a* are clamped into position between two belts 12, 12*a* in a plane 11 defined by the belts 12, 12*a*, more specifically, in the plane defined by the belt tension fibers 13 embedded in the belts 12, 12*a*. The clamping is accomplished by two clamping plates 8 held together by screws mounting the thread suppliers 14, 14*a* positively to the belts. Due to the common motion plane of the belts and the thread suppliers, no bending moments and no tilting moments that could be caused by acceleration and deceleration forces due to the thread supplier motions, are effective on the belts. An additional guide for the thread suppliers is not necessary in this arrangement. One thread supplier or two may be provided for each apparatus.

Although the invention has been described with reference to specific example embodiments, it will be appreciated that it is intended to cover all modifications and equivalents within the scope of the appended claims.

I claim:

1. An apparatus for selecting and supplying different weft threads to a gripper head (15) in a weaving machine, comprising a housing, a driven wheel and a guide wheel supported by said housing, reversible drive means supported by said housing for driving said driven wheel, belt means supported by said driven wheel and by said guide wheel for moving said belt means back and forth, said belt means having a first straight belt run and a second straight belt run, a first thread supplier, first means securing said first thread supplier to said first belt run for travelling back and forth with said first belt run, a second thread supplier, second means securing said second thread supplier to said second belt run for travelling back and forth with said second belt run, said reversible drive means moving said first and second belt runs in opposite directions between limit positions so that in a first limit position said first thread supplier is in a thread presenting position (U) while said second thread supplier is in a ready position and so that in a second limit position said first thread supplier is in a ready position while said second thread supplier is in a thread presenting position.

2. The apparatus of claim 1, wherein said driven wheel and said guide wheel comprise a wheel with a larger diameter and a wheel with a smaller diameter, said wheels having rotational axes spaced from each other so that extension straight lines of said first and second straight belt runs past said wheel with said smaller diameter, intersect at said thread presenting position (U) into which each of said first and second thread suppliers is driven by its respective belt run at different times for presenting a respective weft thread to said gripper head.

3. The apparatus of claim 2, wherein said housing has a guide hole (10) for each of said thread suppliers to reach through said guide hole out of said housing.

4. The apparatus of claim 1, wherein said first and second thread suppliers exchange their respective positions in response to rotation of said driven wheel in one direction or the opposite direction.

5. The apparatus of claim 1, wherein said driven wheel and said guide wheel have the same diameter, whereby said first and second belt runs run in parallel to each other and said first and second thread suppliers also extend in parallel to each other.

6. The apparatus of claim 1, wherein said first and second means securing said first and second thread suppliers comprise clamping means for positively securing said first and second thread suppliers to said belt means.

7. The apparatus of claim 6, wherein said clamping means comprise two plates one on each side of said belt means and clamped together to hold the respective thread supplier in a plane (11) defined by said belt means.

8. The apparatus of claim 1, wherein said belt means comprise two belts (12, 12*a*) looped around said driven wheel and said guide wheel, said two belts running in parallel to each other and in a common plane, said first and second means for securing said first and second thread suppliers securing said thread suppliers to both belts and between both belts in said common plane of both belts so that said thread suppliers are substantially prevented from applying bending moments to said two belts.

* * * * *